United States Patent [19]

Suolahti

[11] Patent Number: 4,914,891

[45] Date of Patent: Apr. 10, 1990

[54] METHOD AND APPARATUS FOR EXCHANGING FILM ROLLS IN A WRAPPING MACHINE

[75] Inventor: Yrjö Suolahti, Mynämäki, Finland

[73] Assignee: Oy M. Haloila AB, Finland

[21] Appl. No.: 198,973

[22] Filed: May 26, 1988

[30] Foreign Application Priority Data

May 27, 1987 [FI] Finland ..... 872358

[51] Int. Cl.[4] ..... B65B 11/02; B65B 41/12

[52] U.S. Cl. ..... 53/399; 53/441; 53/556; 53/587; 53/389

[58] Field of Search ..... 53/399, 441, 211, 556, 53/588, 389; 242/58.6, 79

[56] References Cited

U.S. PATENT DOCUMENTS

| | | | |
|---|---|---|---|
| 3,374,963 | 3/1968 | Conti | 242/58.6 X |
| 3,546,850 | 12/1970 | Hatanaka | 53/389 |
| 4,172,565 | 10/1979 | Zaffarano | 242/68.4 |
| 4,537,368 | 8/1985 | Radmore | 242/58.6 |
| 4,685,270 | 8/1987 | Bembilla | 53/556 |

*Primary Examiner*—John Sipos

*Attorney, Agent, or Firm*—Steinberg & Raskin

[57] ABSTRACT

Method and apparatus for exchanging film rolls during a wrapping operation in a wrapping machine which is arranged to wind wrapping film around the product being packaged, the product being stationary or rotated around a horizontal axis. The wrapping machine includes a film distribution sledge provided with tension rolls mounted on a rotatable wrapping crank. A cassette or the like holding a plurality of new film rolls is provided at a film roll exchange station. A transfer sledge removes an old film roll or bushing from the film distribution sledge and transfers a new film roll or bushing from the cassette into the film distribution sledge. A device is provided at the exchange station for passing an end region of the film of the new film roll over the tension rolls of the film distribution sledge to a grasping member during the film roll exchange operation. A frame carrying a set of press rolls is coupled to the film distribution sledge so as to moveable between a closed position in which the press rolls are pressed against the tension rolls and an open position in which the press rolls are spaced from the tension rolls. The new film roll is shifted by the transfer sledge into the film distribution sledge through the space between the press and tension rolls when the press roll-carrying frame is in its open position.

11 Claims, 3 Drawing Sheets

METHOD AND APPARATUS FOR EXCHANGING FILM ROLLS IN A WRAPPING MACHINE

BACKGROUND OF THE INVENTION

The present invention relates to apparatus for exchanging a film roll in a machine for wrapping a product with wrapping film while the product is either stationary or rotated around a horizontal axis. The wrapping machine includes a rotating wrapping crank which carries a film distribution sledge having tension rolls and which carries a roll of wrapping film. The film is wrapped around the product as the wrapping crank rotates.

The invention also relates to a method for exchanging a film roll during operation of the wrapping machine wherein an old film roll is removed from the film distribution sledge and a new film roll shifted in its place.

Two different arrangements are commonly used in wrapping film or the like around various products being packaged. In the first arrangement, the product to be packaged is situated on a revolving base. Film is wrapped around the product as the product itself is rotated on the revolving base. This arrangement has a number of drawbacks. For example, when the product being wrapped comprises a plurality of units, it is difficult to maintain the units in a compact assembly on the revolving base. It is also difficult and expensive to provide additional functions and to automate the packaging operation.

According to the second arrangement in common use, the product being packaged is maintained in a stationary position in the wrapping machine while the film is wound around the product, i.e., the film roll is moved around the product. This arrangement is considered to be more advanced than the arrangement where the product is rotated, and, among other things, can be more easily provided with additional functions to facilitate automation of the wrapping operation.

However, in neither of the arrangements discussed above has it been possible to automate the exchanging of the wrapping film rolls such as when the film roll is exhausted.

In particular, at the present time, the rolls have been manually exchanged. The wrapping film roll must always be changed when the film has broken for some reason, or of course, when the film has been exhausted from the roll. Due to the necessity of manually exchanging the wrapping film rolls, it has been necessary to limit the weight of the wrapping film rolls to a maximum of about 30 kg so that the new film roll can be lifted into position. However, this in turn results in the wrapping film being exhausted in a relatively short time making it necessary to exchange the rolls on a more frequent basis than is desired. Further, the manual exchange of wrapping film rolls involves certain safety risks and hazards.

Another drawback inherent in the manual exchange of film rolls in a wrapping machine is that the leading end of the film on the new film roll had to be threaded between a number of tension rolls mounted on the film distribution sledge. This is a cumbersome operation involving the risk of the operator's fingers becoming caught between the rolls.

SUMMARY OF THE INVENTION

Accordingly, an object of the present invention is to provide new and improved methods and apparatus for exchanging film rolls in a wrapping machine.

Another object of the present invention is to provide new and improved methods and apparatus for exchanging film rolls in a wrapping machine which overcome the drawbacks discussed above.

Briefly, in accordance with the apparatus of the present invention, these and other objects are attained by providing the film distribution sledge mounted on the wrapping crank of the machine with a set of press rolls carried on a frame coupled to the film distribution sledge, and means for moving the press roll-carrying frame between a closed position in which the press rolls are pressed against the tension rolls of the distribution sledge and an open position in which the press rolls are spaced from the tension rolls. The press roll-carrying frame is arranged to move to the open position in an exchange station during a film roll exchange operation so that a new film roll can be shifted into the film distribution sledge through the space between the press rolls and tension rolls.

The objects of the invention are also attained by providing a method in accordance with the invention including the steps of moving a set of press rolls carried on a frame coupled to the film distribution sledge from a closed position in which the press rolls are pressed against the tension rolls of the distribution sledge to an open position in which the press rolls are spaced from the tension rolls, shifting a new film roll into the film distribution sledge through the space between the set of press rolls and the tension rolls, passing a leading end region of the film from the new film roll over the tension rolls to a grasping member in which the leading end region of the film is held, and moving the set of press rolls carried on the frame to the closed position so that the film remains between the tension rolls and press rolls for adjusting the tension of the film.

Several important advantages are obtained by the method and apparatus of the invention. For the first time it is possible to automate the film roll exchange operation in a wrapping machine. In turn, the time intervals between exchanges of film rolls is increased significantly as compared to the short time intervals inherently required by manual exchange operations. In other words, it is possible to use substantially larger and heavier film rolls in the wrapping machines constructed in accordance with the invention. Operation of wrapping machines constructed in accordance with the invention is also safer since the film rolls need not be exchanged in a manual fashion.

DESCRIPTION OF THE DRAWINGS

A more complete appreciation of the present invention and many of the attendant advantages thereof will be readily understood by reference to the following detailed description when considered in connection with the accompanying drawings which illustrate an embodiment to which the invention is not limited, and in which.

DETAILED DESCRIPTION OF THE PREFERRED EMBODIMENT

Figure 1:
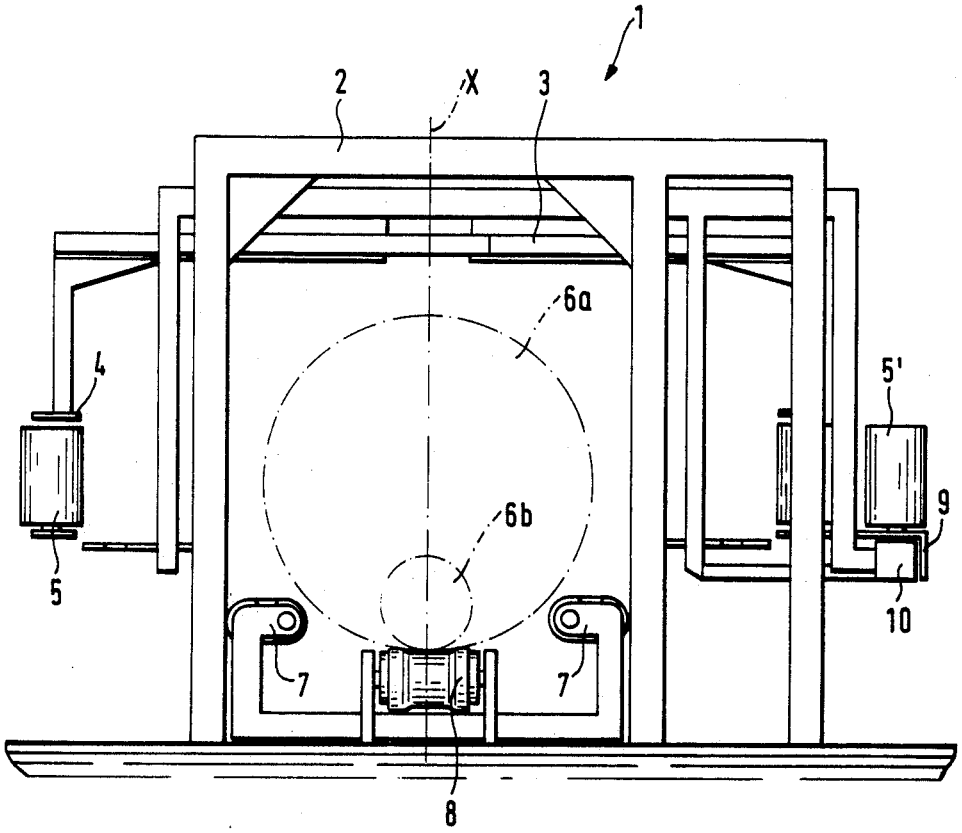
FIG. 1 is a schematic end view of a wrapping machine in which methods and apparatus in accordance with the invention are incorporated.

Referring now to the drawings wherein like reference characters designate identical or corresponding parts throughout the several views, and more particularly to FIG. 1, a wrapping machine 1 to which film roll exchange apparatus in accordance with the invention can be applied, is illustrated. The wrapping machine 1 illustrated in FIG. 1 is adapted for wrapping cylindrical products, such as paper rolls and the like, with a wrapping film. The wrapping machine 1 includes a frame 2 on which a wrapping crank 3 is mounted for rotation around a central axis X. A film distribution sledge 4 is carried by the wrapping crank and carries a film roll 5 during the wrapping operation. The wrapping machine can wrap cylindrical products of any size and this is indicated in FIG. 1 through the illustration of a larger product 6*a* and a smaller product 6*b*. The product 6*a*, 6*b* to be packaged is conveyed into the wrapping machine 1 on a conveyor belt 8. Upon the product being conveyed into the wrapping machine 1, it is raised from the conveyer belt 8 onto a pair of driven support rollers 7 by means of which the product is rotated during the wrapping operation. By this arrangement, the product 6*a*, 6*b* to be packaged can be completely wrapped in the wrapping film.

A cassette 9 supporting a number of new film rolls 5′ is mounted at the side of wrapping machine 1. The cassette 9 is moveably mounted on a guide 10 of the machine frame. The construction and operation of the exchange equipment of which cassette 9 forms a part will be described in greater detail in connection with FIGS. 3–6.

It will be understood that although the wrapping machine illustrated in FIG. 1 is intended for wrapping cylindrical products to be packaged, the film roll exchange arrangement in accordance with the invention is not limited to use only in such machines. For example, the film roll exchange arrangement of the invention can also be applied to wrapping machines in which the product to be wrapped is maintained stationary during the wrapping operation while the film roll is rotated around the product.

Figure 2:
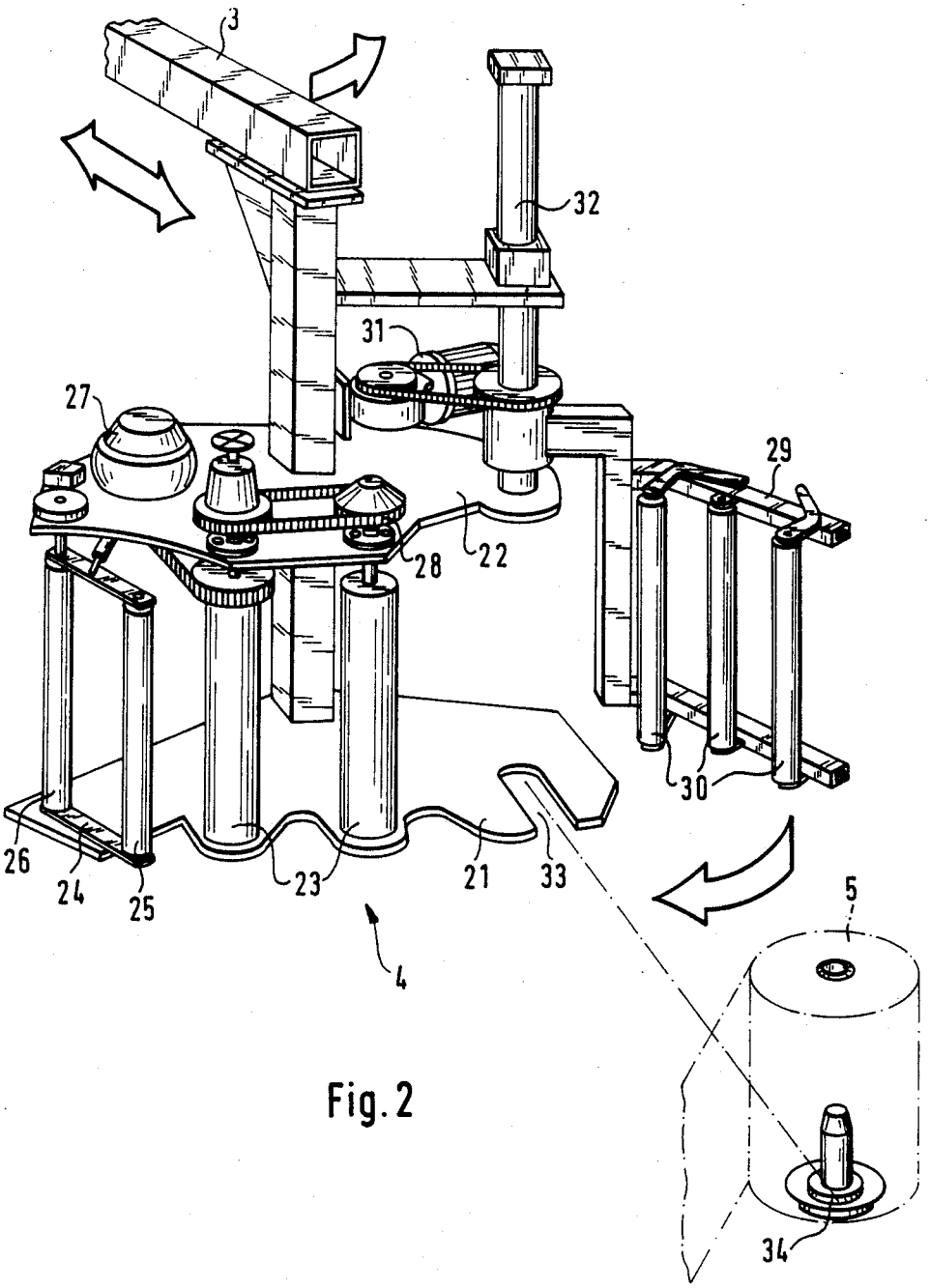
FIG. 2 is a schematic perspective view of a film distribution sledge incorporating apparatus in accordance with the invention for performing a method in accordance with the invention.

Referring now to FIG. 2, a distribution sledge 4 constructed in accordance with the invention is illustrated. The film distribution sledge 4 is mounted on the wrapping crank 3 and comprises frame plates 21 and 22 vertically spaced from each other. A slot 33 is formed in the lower frame plate 21 into which the bushing 34 of film roll 5 is received when the film roll is carried into the distribution sledge. Film tension rolls 23 are mounted between frame plates 21 and 22 over which the wrapping film passes during the wrapping operation. The film distribution sledge 4 is also provided with a film tension detector 24 including rolls 25 and 26 over which the wrapping film passes during the wrapping operation. The film tension detector 24 is pivotably mounted in the film distribution sledge 4 so that the tension detector is pivoted in accordance with the tension of the wrapping film. When the tension of the film reaches a certain level, the tension detector 24 sends a signal to a motor 27 which operates the tension rolls 23 through an actuating device 28 for reducing the tension in the film.

In accordance with the invention, a set of press rolls 30 are carried on a frame 29 which is pivotally mounted on the film distribution sledge 4. The press rolls 30 are arranged so that when the press roll-carrying frame 29 is in a closed position, the press rolls 30 are substantially interdigitated with tension rolls 23 pressing against them to press the wrapping film between the tension rolls 23 and press rolls 30. This operation is more clearly illustrated in FIGS. 3–7, discussed below.

A pivot motor 31 is coupled to the press roll-carrying frame 29 and functions to move the set of press rolls between the closed position in which the press rolls 30 are pressed into contact with the tension rolls 23, and an open position (shown in FIG. 2) in which the press rolls 30 are spaced from the tension rolls 23.

The film distribution sledge 4 is further provided with a locking cylinder 32 fitted over the slot 33 by means of which the film roll 5 is locked into position in the distribution sledge. Locking cylinder 32 is vertically adjustable to permit the use of film rolls 5 of different width in the film distribution sledge 4. The film roll 5 is thus attached in position to the film distribution sledge 4 by means of the locking cylinder 32. However, the lower end of locking cylinder 32 is shaped such that it will not prevent rotation of film roll 5. The lower end of the locking cylinder 32 may also be provided with suitable braking devices or the like by means of which the rotation of film roll 5 can be slowed to adjust the tension of the wrapping film to a desired level.

The steps in a film roll exchange operation in accordance with the invention are schematically illustrated in FIGS. 3–6. The film distribution sledge 4 is shown in an exchange station of the film roll wrapping machine in each of those figures.

Figure 3:
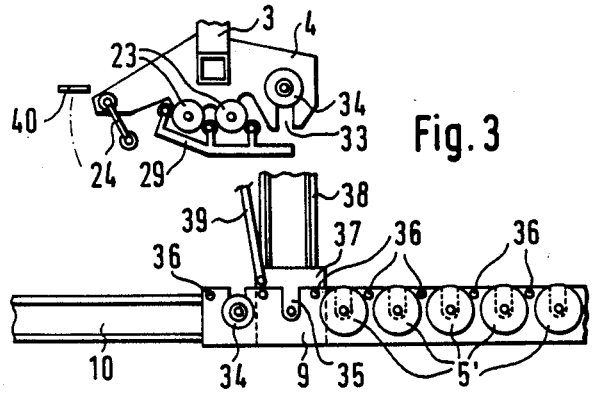
FIGS. 3–6 are schematic top plan views of sequential steps of a film roll exchange operation in accordance with the invention.

The film distribution sledge 4 arrives in the film roll exchange station as illustrated in FIG. 3. All of the wrapping film has been exhausted from the film roll leaving only an empty bushing 34 in slot 33 of the film distribution sledge 4. The frame 29 and the set of press rolls 30 carried thereon is in the closed position and press rolls 30 press against tension rolls 23. The cassette 9 provided with a plurality of new film rolls 5′ is moveably mounted along guides 10. The new film rolls 5′ are fixed in cassette 9 on fastening bushings 34 of the type illustrated in FIG. 2. Slots 35 extending in a direction transverse to the guides 10 are formed in cassette 9 for receiving the bushings 34 of the new film rolls 5′. Moreover, for each film roll 5′ carried in cassette 9, a holder device 36 is provided for holding the leading end region of the film.

A transfer sledge 37 is arranged to move in a direction transverse to the guides 10 and cassette 9. The transfer sledge 37 moves on guides 38 between the cassette 9 and the film distribution sledge 4. As seen in FIG. 3, the film distribution sledge 4 has indexed to and stopped in the film roll exchange station at a position where the slot 33 in the film distribution sledge 4 is situated precisely on the centerline of guides 38 of the transfer sledge 37. The cassette 9 is arranged to move along guides 10 so that when the film distribution sledge 4 stops in the exchange station, an empty slot 35 in cassette 9 is aligned with the centerline of guides 38 of the transfer sledge 37 to facilitate receiving an exhausted film roll 5 or bushing 34 from the distribution sledge 4. In the step illustrated in FIG. 3, since the film distribution sledge 4 has just arrived at the film roll exchange station, the film roll transfer sledge 37 is situated at the end of guide 38 next to cassette 9.

Still referring to FIG. 3, a transfer member 39 for the leading end region of the film as well as the locking or grasping member 40 for the leading end of the film are illustrated. In the course of shifting a new film roll 5' from cassette 9 into the film distribution sledge 4, the leading end region of the film of the new roll 5' is, at the same time, passed by means of the film end transfer device 39 from the holder 36 to the grasping member 40. The transfer device 39 is pivotally coupled in a suitable fashion to, for example, the frame of the wrapping machine or to the frame of the exchange equipment, and includes means for engaging the leading end region of the film to detach it from holder 36 and to pass it to the locking or grasping member 40 which is also similarly fixed to the frame of the wrapping machine or to the frame of the exchange equipment. The locking or grasping member 40 of the leading end region of the film is provided with suitable locking means by which the leading end region of the film can be maintained in position until its detachment is required.

Figure 4:
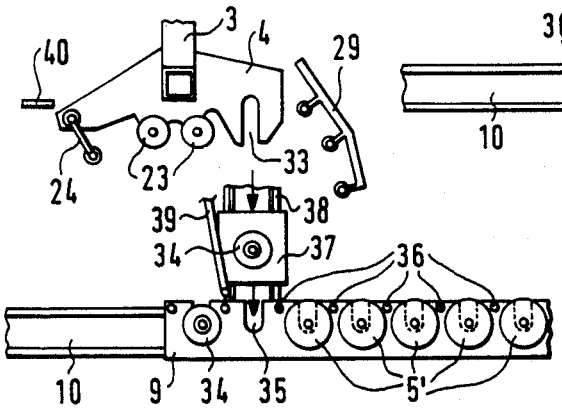

After the film distribution sledge 4 has stopped in the exchange station (FIG. 3), the frame 29 carrying the press roll 30 is pivoted to its open position as seen in FIG. 4 whereupon the press rolls 30 move out of contact with the tension rolls 23 to a position spaced therefrom. At this time, the film roll transfer sledge 37 begins movement along guides 38 towards the film distribution sledge 4 until it engages and interlocks with the bushing 34 carried therein to move it from the film distribution sledge 4 to the available slot 35 in cassette 9. The locking cylinder 32 has been previously raised to the position shown in FIG. 2 to release the bushing 34. The film roll transfer sledge 37 thus detaches the empty bushing 34 from the film distribution sledge 4 and shifts it, as shown in FIG. 4, into the empty slot 35 of cassette 9 situated along the center line of guides 38 of transfer sledge 37. After the empty bushing has been transferred to the slot 35, the cassette 9 is moved to a new position at which a full new film roll 5' is aligned on the centerline of guides 38 of transfer sledge 37 facing the film roll transfer sledge 37.

Figure 5:
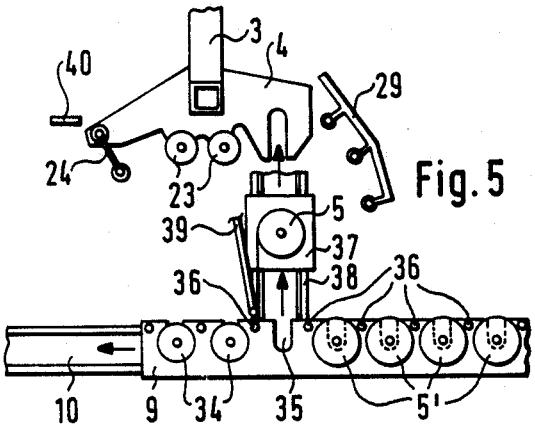

The next step in the film roll exchange operation in accordance with the invention is illustrated in FIG. 5. After the cassette 9 has moved so that a full film roll 5' faces the transfer sledge 37, transfer sledge 37 picks up with the new film roll 5' and shifts it into the slot 33 in distribution sledge 4. At this time, the leading end region of the film of film roll 5' becomes attached to the transfer member 39 by means of holding devices provided therein. Thus, the leading end region of the film is detached from the corresponding holder 36 of cassette 9.

Figure 6:
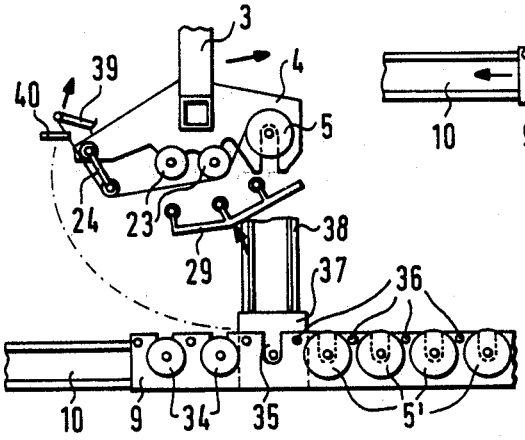

The next step in the film roll exchange operation is illustrated in FIG. 6. When the new film roll 5' has been shifted into the film distribution sledge 4, the transfer member 39 carries the leading end region of the film to the locking or grasping member 40 where it becomes held thereby. As seen in FIG. 6, the film passes over the tension rolls 23 and over the rolls 25 and 26 of the film tension detector 24. When the leading end region of the film has become fixed in the grasping member 40, the transfer member 39 is returned to its initial position. At this time, the frame 29 carrying the set of press rolls 30 is moved to its closed position so that the film is pressed between the press rolls 30 and the tension rolls 23. The transfer sledge 37 returns to the end of the guides 38 proximate to cassette 9 whereupon the rotation of the wrapping crank 3 is initiated to restart the wrapping operation. The grasping member 40 releases the leading end of the film from its grasp upon the wrapping crank 3 and film distribution sledge 4 carried thereby having completed at least one rotation.

The set of press rolls is therefore moved between said open and closed positions by pivoting said press roll-carrying frame around a shaft which is substantially parallel to shafts of said tension rolls.

In the description of the invention set forth above, it has been assumed that a film roll is replaced by a new film roll after the former has been entirely exhausted. It will be understood, however, that it is also possible to exchange film rolls even at a time when some film still remains in the film roll carried in the film distribution sledge 4. For example, this exchange may be indicated if the nature or size of the product being packaged is changed such that it is necessary to use a film having a different width or thickness.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a machine for wrapping film around a product to be packaged including a rotatable wrapping crank, a film distribution sledge provided with tension rolls mounted on said wrapping crank, said film distribution sledge adapted to carry a roll of wrapping film which is wrapped around the product as said wrapping crank rotates, the improvement comprising apparatus for automatically exchanging wrapping film rolls carried in said film distribution sledge, said film roll exchange apparatus comprising:

a set of press rolls carried on a frame coupled to said film distribution sledge;

means for moving said press roll-carrying frame between a closed position in which said press rolls are pressed against said tension rolls and an open position in which said press rolls are spaced from said tension rolls; and said press roll-carrying frame arranged to move to said open position prior to a film roll exchange operation so that a new film roll can be automatically shifted into said film distribution sledge through the space between said press rolls and said tension rolls.

2. The combination of claim 1, wherein said press rolls are rotatably mounted upon said frame.

3. The combination of claim 1, wherein said press rolls are arranged to be substantially interdigitated with said tension rolls when said frame is in said closed position.

4. The combination of claim 1, wherein said frame is pivotally coupled to said sledge.

5. In a machine for wrapping film around a product to be packaged including a rotatable wrapping crank, a film distribution sledge provided with tension rolls mounted on said wrapping crank, said film distribution sledge adapted to carry a roll of wrapping film which is wrapped around the product as said wrapping crank rotates, the improvement comprising apparatus for exchanging wrapping film rolls carried in said film distribution sledge, said film roll exchange apparatus comprising:

a set of press rolls carried on a frame coupled to said film distribution sledge;

means for moving said press roll-carrying frame between a closed position in which said press rolls are pressed against said tension rolls and an open position in which said press rolls are spaced from said tension rolls; and said press roll-carrying frame arranged to move to said open position prior to a film roll exchange operation so that a new film roll can be shifted into said film distribution sledge through the space between said press rolls and said tension rolls; further including means for grasping a leading end region of the film of said new film roll;

transfer means for passing said leading end region of the film of said new film roll over said tension rolls to said grasping means; and said press roll-carrying frame arranged to move to said closed position after said new film roll is shifted into said film distribution sledge so that said press rolls and said tension rolls press the film between them for adjusting the tension of the film.

6. The combination of claim 5 wherein said transfer means passes said leading end region of the film over said tension rolls to said grasping means as said new film roll is shifted into said film distribution sledge.

7. In a machine for wrapping film around a product to be packaged including a rotatable wrapping crank, a film distribution sledge provided with tension rolls mounted on said wrapping crank, said film distribution sledge adapted to carry a roll of wrapping film which is wrapped around the product as said wrapping crank rotates, the improvement comprising apparatus for exchanging film rolls carried in said film distribution sledge, said film roll exchange apparatus comprising:

a set of press rolls carried on a frame coupled to said film distribution sledge;

means for moving said press roll-carrying frame between a closed position in which said press rolls are pressed against said tension rolls and an open position in which said press rolls are spaced from said tension rolls; and means situated at a film roll exchange station for shifting a new film roll into said film distribution sledge through said space between said press rolls and said tension rolls when said press roll-carrying frame is in said open position.

8. The combination of claim 7 further including cassette means situated at said film roll exchange station for carrying a plurality of new film rolls, said shifting means including means for shifting a new film roll from said cassette means into said film distribution sledge through said space between said press rolls and said tension rolls when said press roll-carrying frame is in said open position.

9. The combination of claim 8 wherein, said distribution sledge includes a slot for receiving a new film roll; and means for moving said cassette means to a position wherein a new film roll is aligned with said slot.

10. A method for exchanging film rolls in a machine for wrapping film around a product to be packaged, said wrapping machine including a rotatable wrapping crank, a film distribution sledge provided with tension rolls mounted on said wrapping crank, said film distribution sledge adapted to carry a roll of wrapping film which is wrapped around the product as said wrapping crank rotates, comprising the steps of:

moving a set of press rolls carried on a frame coupled to said film distribution sledge from a closed position in which said press rolls are pressed against said tension rolls to an open position in which said press rolls are spaced from said tension rolls;

shifting a new film roll into said film distribution sledge through the space between the set of press rolls and the tension rolls;

passing a leading end region of the film from the new film roll over the tension rolls to a grasping member in which said leading end region is locked; and moving said set of press rolls carried on said frame to said closed position so that the film remains between said tension rolls and said press rolls for adjusting the tension of the film.

11. The method of claim 10 wherein said set of press rolls is moved between said open and closed positions by pivoting said press roll-carrying frame around a shaft which is substantially parallel to shafts of said tension rolls.

* * * * *